United States Patent [19]

Tsubata

[11] 4,210,180

[45] Jul. 1, 1980

[54] WOVEN FASTENER STRINGER

[75] Inventor: Noritaka Tsubata, Uozu, Japan

[73] Assignee: Yoshida Kogyo K.K., Tokyo, Japan

[21] Appl. No.: 971,268

[22] Filed: Dec. 20, 1978

[30] Foreign Application Priority Data

Dec. 29, 1977 [JP] Japan ..... 53-85
Dec. 29, 1977 [JP] Japan ..... 53-86

[51] Int. Cl.[2] ..... A44B 19/10
[52] U.S. Cl. ..... 139/384 B; 24/205.16 C
[58] Field of Search ..... 139/384 B; 24/205.1 C, 24/205.13 C, 205.16 C

[56] References Cited

U.S. PATENT DOCUMENTS 3,022,803 2/1962 Berberich et al. ..... 24/205.16 C
3,921,679 11/1975 Glindmeyer et al. ..... 139/384 B

FOREIGN PATENT DOCUMENTS 2333152 1/1975 Fed. Rep. of Germany ..... 138/384 B
2519829 11/1976 Fed. Rep. of Germany ..... 139/384 B
50-85445 7/1975 Japan ..... 139/384 B

*Primary Examiner*—Henry Jaudon
*Attorney, Agent, or Firm*—Bucknam and Archer

[57] ABSTRACT

A slide fastener stringer is disclosed, while has a woven tape carrying a row of coupling loops which is likewise woven, instead of being stitched, into an edge of the tape. The row of loops is secured by a plurality of binding warp threads extending longitudinally of the tape and overlying the upper portion of each of successively interconnected loops. A binding weft thread, separate from the tape foundations weft, is interlaced with the binding warp threads in a plane defined commonly by the successive upper portions of the loops and interwoven with the foundation weft thread interiorly of a heel portion of the loop, thereby securing the loops firmly to the tape without any such thread behind the heel of the loop which would otherwise interfere with the movement of a slider.

6 Claims, 9 Drawing Figures

FIG. 3
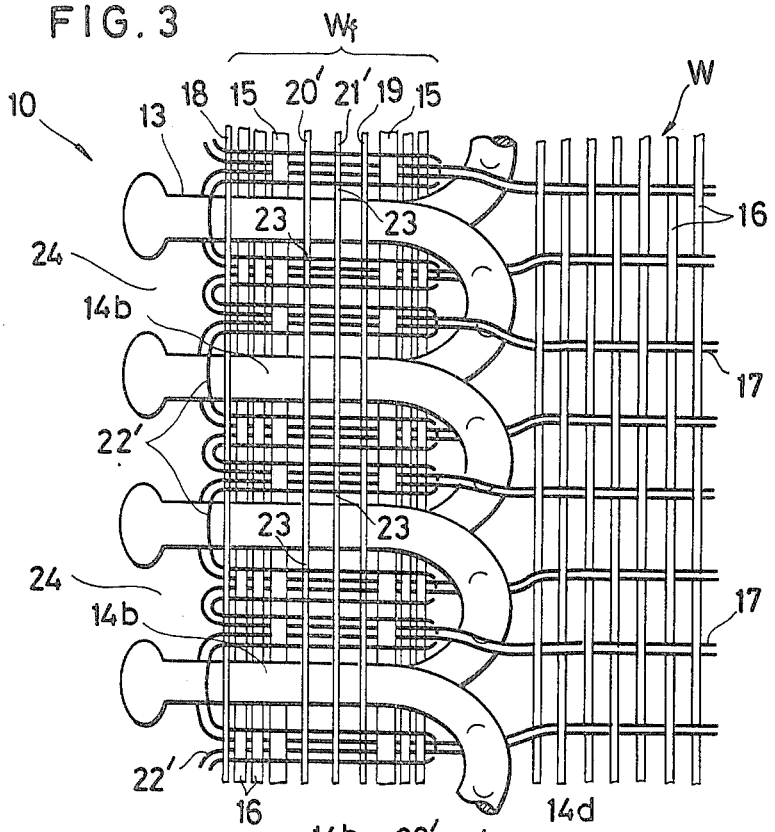
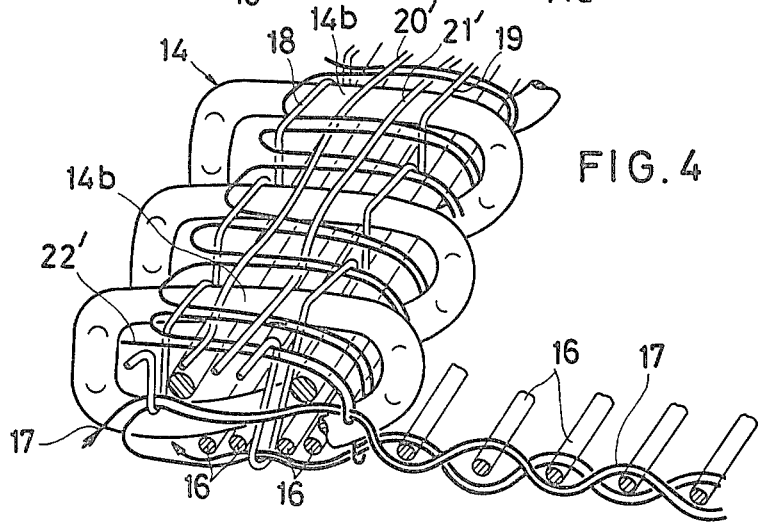
FIG. 4

WOVEN FASTENER STRINGER

BACKGROUND OF THE INVENTION

1. Field of the Invention

This invention relates to a slide fastener, and more particularly to a fastener stringer having a continuous plastic filament spirally formed and woven into an edge of a stringer tape during the weaving thereof by a needle loom.

2. Prior Art

There have been proposed a number of slide fasteners or zippers of the type described, which comprise a woven stringer tape and a plastic filament woven into a longitudinal edge of the tape, the filament being usually formed into a helical coil structure consisting of a succession of loops or elongated convolutions each having a coupling head, an upper and a lower leg and a connecting portion. A typical example of such fasteners is disclosed in German Application No. 2519829 wherein a preformed filament carrying a stiffening cord is inserted in the same manner as is the warp and interwoven with the weft into a longitudinal edge of a tape simultaneously as the latter is woven. Since the upper leg of each loop or convolution of the coiled filament in this prior art fastener stringer is not held in place by any weave thread, the result is that adjacent upper legs are prone to move out of the correct pitch, or the coupling filament on one stringer would often become disengaged from a corresponding filament on the other stringer when the fastener is subjected to bending stresses.

Another prior art example is disclosed in U.S. Pat. No. 3,921,679, wherein a warp thread is disposed over the upper legs of the coupling filament and interwoven in the spaces between adjacent filament loops with a weft thread. While this arrangement appears to provide secure anchorage of the coupling filament onto the tape, the warp thread extending over the filament tends to slip along the length of the loops and becomes shifted either toward the coupling head or the connecting portion under the influence of bends or twists, resulting in the failure to couple the two stringers and the breakage of the warp thread in frictional contact with the slider.

Still another prior art fastener stringer is disclosed in Japanese Laid-Open Publication No. 50-85445 wherein additional warp and weft threads are used for binding the coupling filament onto the tape, such threads being interwoven with the corefilled filament over the upper legs of the latter. The binding weft thread in this arrangement passes around externally of the connecting portions of the successive loops and hence extends laterally of the tape so far as to come into frictional engagement with the slider, which would in turn result in sluggish movement of the slider or torn tape threads.

SUMMARY OF THE INVENTION

According to the invention, there is provided a woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section, each of said loops having a coupling head at one end thereof, an upper leg and a lower leg extending from said head in a common direction, and a heel portion at the opposite end remote from said head connected to a next adjacent one of said successive loops; a plurality of reinforcing cores extending longitudinally through said row of elongated loops; and a combination of a first group of binding warp threads extending along a relatively deep undulation path over said upper legs and alternatively overlying and underlying said foundation weft thread, a second group of binding warp threads extending along a relatively shallow undulation path over said upper legs in parallel relation to said first group of binding warp threads, and a binding weft thread interlaced with said first and second groups of binding warp threads substantially in a common plane defined by the upper surfaces of said upper legs and looping around said foundation weft at a position interiorly of said heel portion.

It is therefore an object of the present invention to provide a slide fastener stringer which will eliminate the foregoing difficulties of the prior art.

A more specific object of the invention is to provide such a fastener stringer which has a row of elongated coupling loops stably secured in place against bending stresses and which is free of any thread in the region of movement of a slider, thereby preventing damage to the woven system.

Many other advantages and features of the present invention will become manifest to those versed in the art upon making reference to the detailed description and the accompanying sheets of drawings in which preferred structural embodiments incorporating the principles of the present invention are shown by way of example.

BRIEF DESCRIPTION OF THE DRAWINGS

In the drawings wherein like reference numerals refer to like parts:

FIG. 3 is a view similar to FIG. 1 but showing another embodiment of the invention;

FIG. 4 is a diagrammatic, partly sectional, perspective view of a segment of the fastener stringer shown in FIG. 3;

DETAILED DESCRIPTION OF THE PREFERRED EMBODIMENTS

Figure 1:
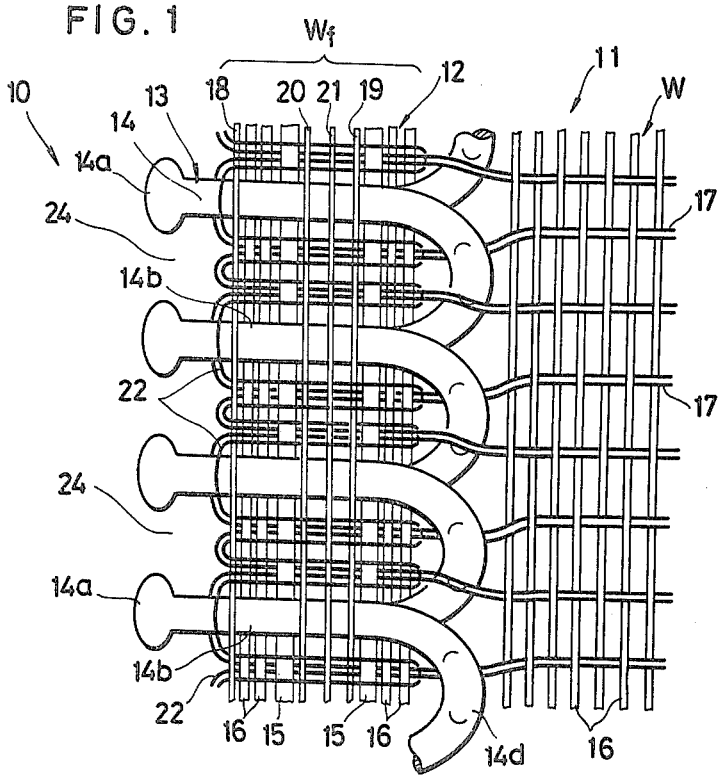
FIG. 1 is a plan view on enlarged scale of a portion of one of two identical fastener stringers according to one embodiment of the invention.
Figure 2:
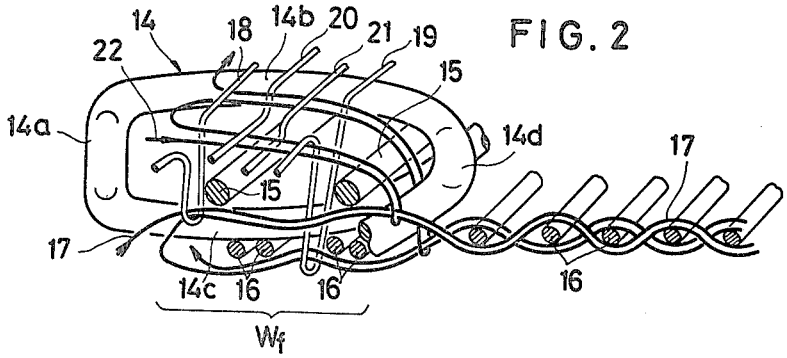
FIG. 2 is a diagrammatic, partly sectional perspective view of a segment of the portion of the fastener stringer shown in FIG. 1.

Referring now to FIGS. 1 and 2 which illustrate a first preferred embodiment of the invention, there is shown a fastener stringer generally designated 10 which constitutes one part of a pair or two identical stringers for a slide fastener. The stringer 10 consists of a generally flat web section W defining a major dimension of a woven tape 11 and a woven filament section $W_f$ defining a longitudinal edge portion 12 into which a filament 13 of plastic material is woven. The filament 13 is formed from a linear blank of a suitable plastic material into a helically coiled structure having a succession of loops or elongated convolutions. This is done during the course of weaving of the tape 11, for example in the manner disclosed in Japanese Laid-Open Publication No. 50-36250.

Each loop or elongated convolution 14 in the filament 13 has a coupling head 14*a* at one end thereof, an upper leg 14*b* and a lower leg 14*c* extending from the head 14*a* in a common direction and a heel portion 14*d* at the opposite end remote from the head 14*a* connected to a next adjacent one of the successive loops 14. The coupling head 14*a* is dimensioned to releasably couple with a corresponding head of a loop 14 on a mating stringer to open and close the fastener in the well known manner. The upper and lower legs 14*b* and 14*c* are spaced apart in substantially superimposed relation to each other as shown in FIG. 1 and define therebetween a longitudinally extending "tunnel" or hollow conduit through which a reinforcing string, cord or core 15 is inserted.

The web section W of the tape 11 may be of any known design having foundation warp threads 16 and foundation weft thread 17 interwoven in a variety of patterns, which will require no further explanation as this has no direct bearing upon the invention.

The term "filament woven section $W_f$" is used to define a longitudinal edge portion of the tape 11 into which the filament 13 serving as a coupling element for a slide fastener is woven. In addition to the foundation warp and weft system in the filament woven section $W_f$, there are provided a first group of binding warp threads 18 and 19 and a second group of binding warp threads 20 and 21 and a continuous binding weft thread 22 cooperating with the binding warp threads 18–21 in binding or anchoring the filament 13 firmly in place on the stringer tape 11. The binding warp threads 18–21 extend longitudinally of the tape 11 in parallel relation to one another and in interlaced relation to the binding weft thread 22. The threads 18–21 all overlie the upper legs 14*b* of the loops 14. The first group of binding warp threads 18 and 19 extend along a relatively deep undulation path, while the second group of binding warp threads 20 and 21 extend along a relatively shallow undulation path, as better shown in FIG. 2, for reasons hereafter explained.

Each of the successive loops 14 of the coupling filament 13 has its lower leg 14*c* secured by the foundation warp 16 and weft 17 onto the woven filament section $W_f$. To further stabilize the fixation of the lower leg 14*c* to the tape 11, the foundation weft 17 is interlaced with the first group of binding warp threads 18 and 19 in the spaces between each pair of elongated loops 14 and in a plane defined commonly by the lowermost surfaces of the lower legs 14*c*, with the results that the first group threads 18 and 19 are oriented to follow a deeply undulated path in the woven filament section $W_f$.

The continuous binding weft thread 22 is inserted substantially in a common plane defined by the uppermost surfaces of the upper legs 14*b* of the successive loops 14 and extends weftwise substantially the entire length of the leg portion 14*b* (14*c*) intermediate the coupling head 14*a* and the heel 14*d* in the spaces between each adjacent pair of loops 14.

The binding weft thread 22 passes around the binding warp thread 18 over the upper leg 14*b* adjacent to the coupling head 14*a* and loops around the foundation weft 17 at a position interiorly of the heel portion 14*d* which interconnects the upper leg 14*b* of one loop with the lower leg 14*c* of a next adjacent loops of the filament 13.

On its return trip, the binding weft thread 22 passes alternately over and under the binding warp threads 18–21 in the spaces between each adjacent pair of loops 14. The second group of binding warp threads 20 and 21 disposed between the thread 18 and the thread 19 are not interengaged with the foundation weft 17 but are interlaced only with the binding weft thread 22 in a plane nearly flush with the common plane of the upper legs 14*b* of the successive loops 14 so that the path of the binding threads 20 and 21 presents itself to be only slightly undulated as shown in FIG. 2. The binding weft thread 22 cooperates with the binding warp threads 18–21 in the binding the upper legs 14*b* in particular against displacement and thus preventing the loops 14 of the filament 13 as a whole from moving out of alignment when the fastener is subjected to bending stresses. The binding weft thread 22, as this is reversed at a point close to the coupling head 14*a*, serves to retain the outermost binding warp thread 18 against slipping along the upper leg 14*b*.

Since the junction of binding weft thread 22 and foundation weft 17 is located internally of the heel or connecting portion 14*d*, not beyond the external surface of this portion, there is no thread behind the heel portion 14*d* which would otherwise interfer with the movement of the slider.

The second embodiment shown in FIGS. 3 and 4 is the same in all respects as the first embodiment which has been discussed, only except for a slight modification in the lay of the binding warp threads 20' and 21' in the second group. It will be noted that a junction 23 of interlacing of the second binding warp threads 20' and 21' with the binding weft thread 22' takes place in the spaces between every other pair of loops 14 of the filament 13, in which instance the junction 23 of one thread 20' is shifted one loop pitch away with respect to the junction 23 of the other thread 21'. In other words, each of the two binding warp threads 20' and 21' extends over the upper surfaces of the upper legs 14*b* of two successive loops 14 and comes into interlaced engagement with the binding weft thread 22' in a next adjoining "inter-leg" space 24 and the junctions 23 of the respective binding warp threads 20' and 21 with the binding weft thread 22' are not in the same "inter-leg" space 24 but alternate with respect to each other.

Figure 5:
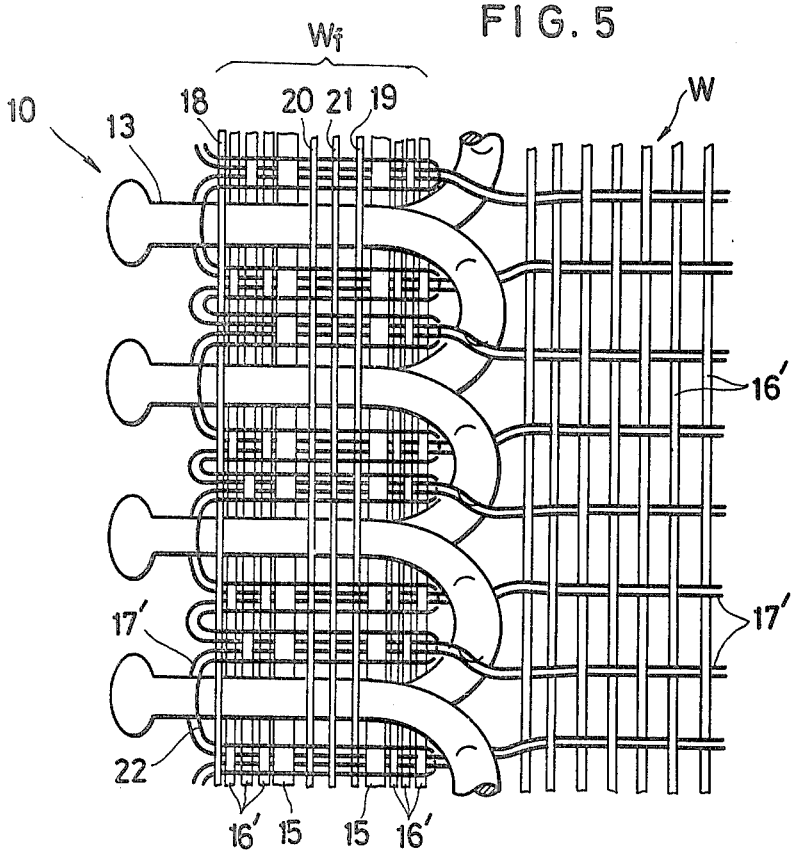
FIG. 5 is a view similar to FIG. 1 but showing a further embodiment of the invention.
Figure 6:
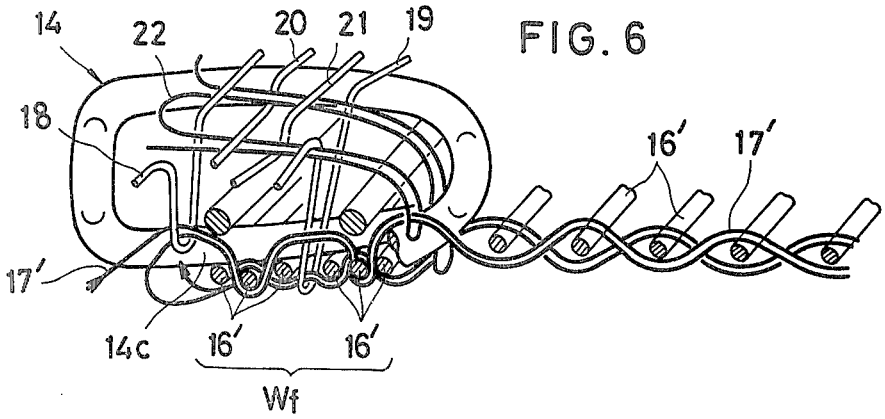
FIG. 6 is a diagrammatic, partly sectional, perspective view of a segment of the fastener stringer shown in FIG. 5.

The third embodiment shown in FIGS. 5 and 6 is directed to the strengthening of the woven filament section $W_f$ particularly with the view to increasing the positional stability of the lower legs 14*c* of the filament loops 14. This is achieved by interweaving the foundation weft thread 17' with the foundation warp threads 16' underlying the lower legs 14*c* in the woven filament section $W_f$, so that the foundation warp threads 16' are constrained and prevented from slipping or displacing with respect to the filament 13.

Figure 7:
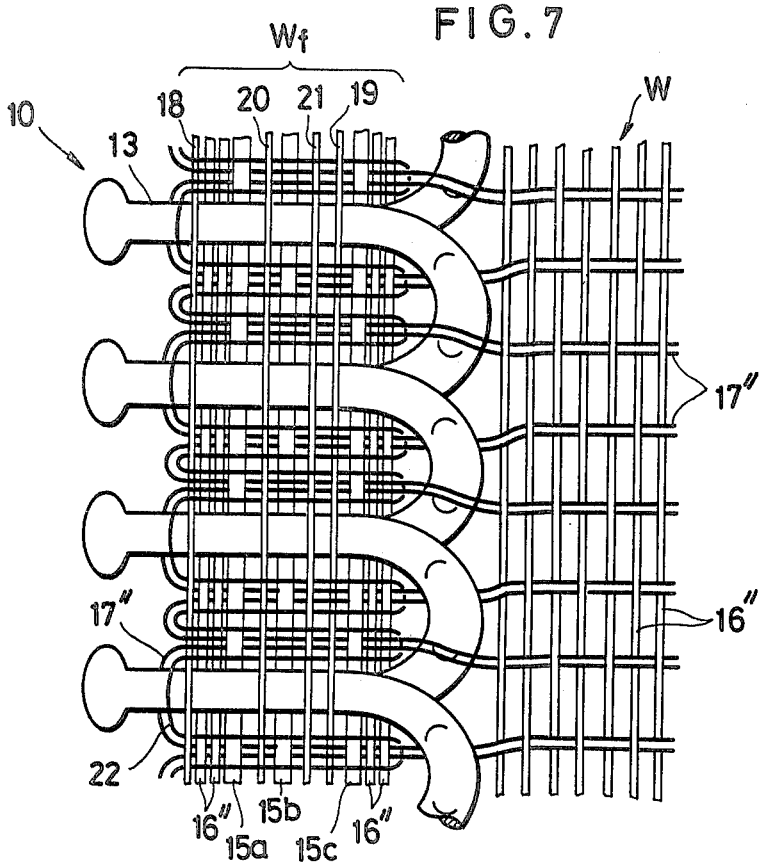
FIG. 7 is a view similar to FIG. 1 but showing still another embodiment of the invention.
Figure 8:
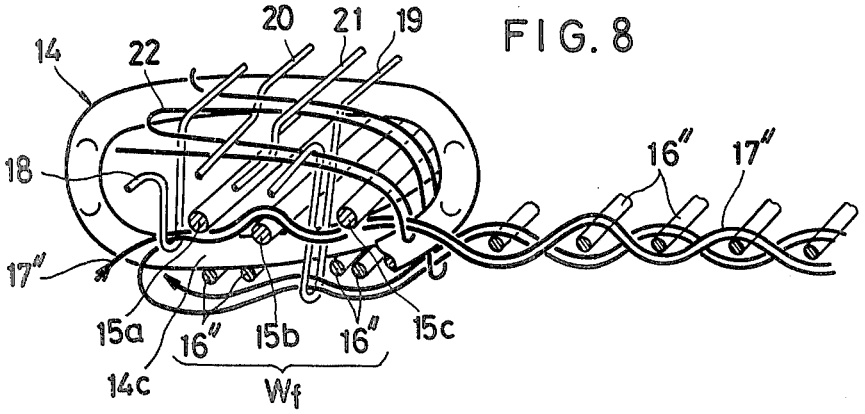
FIG. 8 is a diagrammatic, partly sectional, perspective view of a segment of the fastener stringer shown in FIG. 7.
Figure 9:
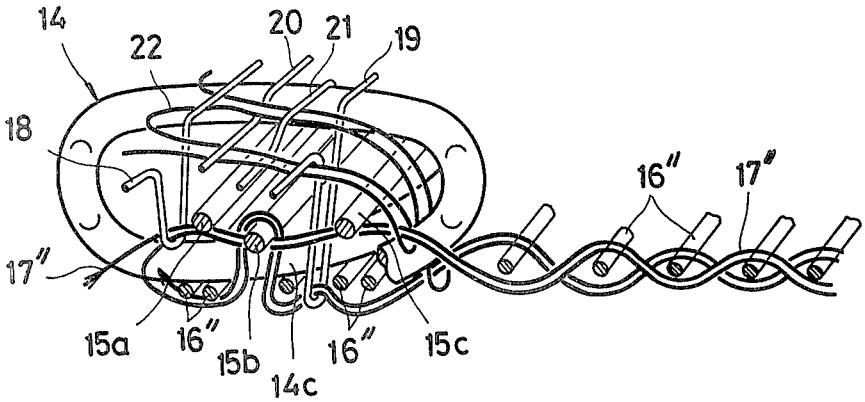
FIG. 9 is a view similar to FIG. 8 but showing a modification of the fastener stringer.

The fourth embodiment shown in FIGS. 7 and 8 is directed to the utilization of a plurality of reinforcing cores or cords 15*a*, 15*b* and 15*c* inserted longitudinally through the turns of the successive elongated loops 14 which are interwoven with the foundation weft threads 17'' in the woven filament section $W_f$, so that the lower legs 14*c* of the loops 14 are firmly retained in place between the cords 15*a*, 15*b* and 15*c* and the foundation warp threads 16". FIG. 9 illustrates a slight modification of the embodiment of FIGS. 7 and 8 in which the middle cord 15*b* alone is interwoven with the foundation weft thread 17" which makes a loop with the cord 15*b* in each inter-leg space 24.

In all the embodiments of the invention which have been advanced hereinabove, it will be noted that the filling or reinforcing cord 15 disposed adjacent the heel portions 14*d* of the filament loops 14 is anchored in place by a weave system consisting of a foundation weft thread 17, a binding warp thread 19 and a binding weft thread 22.

This arrangement provides increased positional stability of the filament 13 with respect to the stringer tape 11.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A woven fastener stringer comprising a woven tape formed with foundation warp and weft threads and consisting of a web section defining a major dimension of said tape and a woven filament section defining a longitudinal edge portion of said tape; a row of successively interconnected elongated loops woven into said filament section, each of said loops having a coupling head at one end thereof, an upper leg and a lower leg extending from said head in a common direction, and a heel portion at the opposite end remote from said head connected to a next adjacent one of said successive loops; a plurality of reinforcing cores extending longitudinally through said row of elongated loops; and a combination of a first group of binding warp threads extending along a relatively deep undulation path over said upper legs and alternatively overlying and underlying said foundation weft thread, a second group of binding warp threads extending along a relatively shallow undulation path over said upper legs in parallel relation to said first group of binding warp threads, and a binding weft thread interlaced with said first and second groups of binding warp threads substantially in a common plane defined by the upper surfaces of said upper legs and looping around said foundation weft at a position interiorly of said heel portion.

2. A woven fastener stringer as defined in claim 1 wherein the junction of interlacing of said binding weft thread with one binding warp thread in the second group is shifted one loop pitch away with respect to the junction of said binding weft thread with another binding warp thread in the second group.

3. A woven fastener stringer as defined in claim 1 wherein said foundation weft thread is interwoven with said foundation warp threads underlying said lower legs of said loops in said woven filament section.

4. A woven fastener stringer as defined in claim 1 wherein said plurality of reinforcing cores are interwoven with said foundation weft thread.

5. A woven fastener stringer of claim 4 wherein said foundation weft thread makes a loop with one of said plurality of reinforcing cores.

6. A woven fastener stringer as defined in claim 1 wherein at least one of said reinforcing cores is bound in place by said binding warp thread in the first group, said foundation weft thread and said binding weft thread.

* * * * *